United States Patent [19]

Seireg et al.

[11] 4,054,783

[45] Oct. 18, 1977

[54] DECOMPRESSION PLAN DEVICE

[75] Inventors: Ali A. Seireg, Madison, Wis.; Amr M. S. Baz, Heliopolis, Egypt

[73] Assignee: Wisconsin Alumni Research Foundation, Madison, Wis.

[21] Appl. No.: 665,172

[22] Filed: Mar. 9, 1976

[51] Int. Cl.[2] ..... G06G 7/60

[52] U.S. Cl. ..... 364/418; 73/291; 73/432 R

[58] Field of Search ..... 235/151.3, 183–184; 128/204; 73/432 R, 291, 299–300, 395–396, 406–407

[56] References Cited

U.S. PATENT DOCUMENTS

| | | | |
|---|---|---|---|
| 3,415,247 | 12/1968 | Louvel et al. | 128/204 |
| 3,457,393 | 7/1969 | Stubbs et al. | 235/184 |
| 3,746,850 | 7/1973 | Moore et al. | 235/184 |
| 3,759,101 | 9/1973 | Borom et al. | 73/291 |

*Primary Examiner*—Edward J. Wise
*Attorney, Agent, or Firm*—Harry C. Engstrom; Theodore J. Long; John M. Winter

[57] ABSTRACT

A device for calculating decompression plans prior to an underwater dive, and for monitoring the depth of a diver during an actual dive and continuously computing a safe decompression plan. The many tissues of a diver which absorb and eliminate inert gas are approximated by a single tissue having different time constants of uptake and elimination of inert gas. These time constants and discrete values of supersaturation ratio may be chosen to allow calculating of diving plans which approximate diving schedules determined empirically.

27 Claims, 4 Drawing Figures

DECOMPRESSION PLAN DEVICE

The Government has rights in this invention pursuant to grant number 04-3-158-5 awarded by the U.S. Department of Commerce.

BACKGROUND OF THE INVENTION

1. Field of the Invention

This invention pertains generally to devices capable of precalculating decompression schedules for underwater divers and also to devices capable of planning safe decompression schedules during a dive.

2. Description of the Prior Art

The problem of decompression sickness, or the "bends," is a well-known phenomena observed in divers who surface after spending substantial periods of time under water. Decompression sickness is caused by the so-called "inert" gas component of the diver's breathing mixture, such as nitrogen in a normal air mixture. As the diver descends, the pressure of the breathing mixture in the diver's lungs must necessarily be increased, and the inert gases in the breathing mixture tend to slowly absorb into the body fluids and tissues of the diver at a rate which depends in part upon the pressure of the breathing mixture. As the diver ascends, the inert gases absorbed by his fluids and tissues are released therefrom and are ultimately discharged from the diver's body through his lungs.

Although the physiological mechanism of decompression sickness is not completely understood, a too rapid release of the pressure on the diver's body will apparently cause the absorbed inert gases to form bubbles within the tissues of the diver which are of sufficient magnitude to cause damage to the body tissues. It has been observed, however, that rapid changes in pressure on the diver's body which do not exceed certain maximum pressure changes will not result in the onset of decompression sickness. It has been found that the ratio of the absolute pressure of the inert gases within the body tissue with respect to the ambient pressure on the body of the diver must not exceed a certain maximum ratio, generally called the supersaturation ratio, if decompression sickness is to be avoided. It has also been found that the supersaturation ratio varies as a function of the absolute tissue pressure.

Since the human body has many different types of tissues, it may be expected that the various tissues in the body would have different supersaturation ratios and different rates at which inert gases are absorbed and eliminated by the tissues. An early model of the actions of the body tissues was proposed by Boycott, Damant and Haldane, "The Prevention of Compressed-Air Illness," *J. Hygiene,* Vol. 8, pp. 342 et seq. (1908), which analogized the human body to a finite number of gas diffusion chambers pneumatically connected in parallel, with each chamber having a different supersaturation ratio and a different time constant of diffusion.

The decompression tables utilized by the United States Navy are substantially based on the theory introduced by Boycott et al. However, other models of the physiological behavior of body tissues under pressure have been developed, and various computational devices have been employed to simulate the body functions based on these models. Typically, such calculators have utilized several body tissue analogs having different time constants, as for example, a plurality of chambers wherein gas under pressure diffuses through a membrane in the compartments. Other calculators have been developed which utilize an electrical analog of such gas diffusion. It is apparent that with such multicompartment models it is necessary to continuously monitor all compartments to determine the highest pressure compartment in order to calculate a safe decompression stop. Such calculators have thus been complicated and are generally expensive.

Most decompression calculators such as those described above are based on physiological models which assume that the time constant of absorption and the time constant of elimination of gas from a tissue are the same. This is not a valid assumption, as demonstrated by H. V. Hempleman, "The Unequal Rates of Uptake and Elimination of Tissue Nitrogen Gas in Diving Procedures," *Medical Research Counsel,* R. N. Personnel Research Committee, U.P.S., pp. 195 et seq., (1960). The complexity required of the multiple compartment decompression plan calculators, or their electrical equivalents, also makes it virtually impossible to account for the differences in supersaturation ratio and tissue time constants which occur from individual to individual.

Various empirically derived tables have been developed by the Navies of the United States, Canada, and other countries. These tables were prepared by testing with subject divers to determine maximum rates of decompression without the onset of decompression sickness. While these tables are useful, they do not have sufficient data to plan dives which vary in time and depth from the dive plans used in preparing the tables. It may also be noted that the decompression tables of the various Navies do not agree uniformly. For example, the tables of the Canadian Navy prescribe a more conservative (longer duration) decompression schedule than do the U. S. Navy tables for dives of relatively short duration.

SUMMARY OF THE INVENTION

The decompression plan device of our invention can be utilized to calculate a safe and efficient diving plan prior to the undertaking of a dive, or alternatively, will plan safe decompression stops during the actual dive. The decompression plan device approximates the many tissue time constants of a human being with a single tissue having a time constant of uptake of inert gas and a time constant of elimination of inert gas, with the two time constants being substantially different. The decompression plans are computed with discrete values of supersaturation ratio being used to approximate the actual continuous variation of the supersaturation ratio, with the discrete values being selected depending on the length of the dive at the working depth. We have determined that our decompression plan device using these approximations is capable of calculating diving schedules which closely approximate the empirically derived diving tables to provide diving schedules that are "safe" with respect to these tables, yet which also allow the diver to decompress in an amount of time which is also comparable to the times specified in the empirically derived tables.

Our decompression plan device is capable of computing decompression schedules in either a real time mode or a scaled time mode. In the real time mode the ambient pressure at the depth at which the diver is located is continuously monitored, and a safe decompression stop is continuously calculated based on a continuous calculation of the diver's tissue pressure. The diver may ascend to the surface from any depth by always remaining at a depth greater than or equal to the decompression stop depth shown by the decompression plan device, until the diver reaches a depth at which it is possible to ascend to the surface in a single decompression stop. The decompression plan device gives the amount of time that the diver must remain at such a depth in order to safely surface.

For decompression plans that are calculated at the surface in the scaled time mode before the diver begins his dive, our decompression plan device may be programmed to calculate a decompression stop depth required given an initial tissue pressure in the diver's tissues (or a depth equivalent thereto), the working depth of the dive, and the time that the diver will spend at the working depth. The decompression plan device then provides a first safe decompression stop and the amount of time that the diver must spend at this stop if the surface can be reached directly after only one stop. If more than one stop is required, the amount of time that the diver chooses to remain at the first decompression stop may be set on the device along with his initial tissue pressure at the time he reaches the first stop, and the device will calculate the next safe decompression stop. If the surface again cannot be reached without further decompression stops, the process may be repeated to calculate other decompression stops required.

When operating in the scaled time mode, a working depth monitor is set by the operator to provide an electrical signal which corresponds to the planned working depth pressure $P_w$. A tissue pressure computing circuit utilizes this working depth pressure to calculate the instantaneous simulated tissue pressure as function of time, with the amount of time that the tissue pressure computing circuit operates being determined by a time at working depth control. A comparator compares the simulated tissue pressure with the working depth pressure and controls the tissue pressure computing circuit to use a time constant $T_u$ (corresponding to a proper uptake time constant) where the tissue pressure is less than the working depth pressure, and to use a different time constant $T_e$ where the tissue pressure is greater than the working depth pressure. The output of the tissue pressure computing circuit is a signal corresponding to the simulated tissue pressure $P_{ei}$, and is provided to a display unit which displays the decompression stop depth. The display unit also displays the decompression time required where the surface can be reached from such decompression stop without the necessity of further decompression stops.

Where our decompression plan device is being used in real time to calculate decompression schedules continuously during the actual dive, an electrical signal corresponding to the working depth pressure $P_w$ is provided by a working depth monitor which utilizes a pressure transducer carried with the diver to continuously measure the ambient pressure of the diver. This working depth signal $P_w$, which varies continuously with the depth of the diver, is then provided to the tissue pressure computing circuit along with the initial pressure signal $P_i$ and is utilized as indicated above to compute an electrical signal corresponding to the simulated tissue pressure due to the uptake and elimination of inert gases in a single simulated tissue having an uptake time constant and a different elimination time constant. Another comparator is also provided which compares the instantaneous tissue pressure signal $P_{ei}$ with a chosen supersaturation ratio times the working depth pressure signal $P_w$. If the tissue pressure exceeds the product of the chosen supersaturation ratio and the working depth pressure, the comparator provides a signal to a warning indicator to warn the diver or the operator at the surface that the diver is ascending too fast and is risking the onset of decompression sickness.

Further objects, features and advantages of our invention will be apparent from the following detailed description taken in conjunction with the accompanying drawings showing a preferred embodiment of a decompression plan device exemplifying the principles of our invention.

DESCRIPTION OF THE PREFERRED EMBODIMENT

Figure 1:
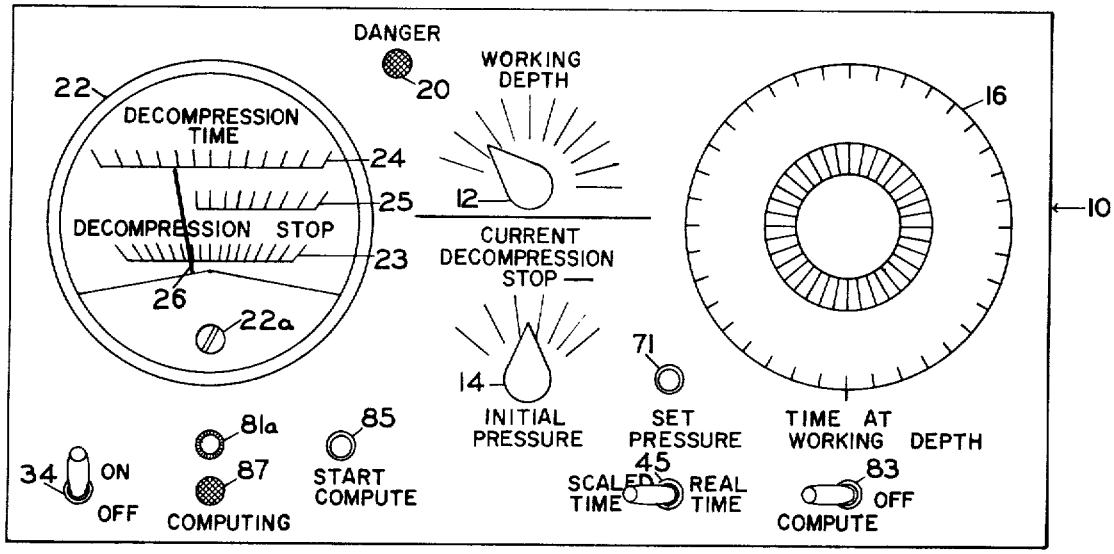
FIG. 1 is a front view of the face of our decompression plan device.

We have determined that it is possible to accurately and safely estimate the diving plan required by utilizing a model employing a first time constant for absorption of inert gas by a single body tissue, and a second different time constant for the elimination of absorbed gases by a single body tissue. The use of a single tissue model with an asymmetrical time constant, employed with the assumption of at least one discrete supersaturation ratio, allows diving plans to be calculated quickly as well as safely and accurately, and further provides for the adaptation of diving plans to different individuals, work loads and environmental temperatures. We have determined that proper selection of a discrete supersaturation ratio can be accomplished in accordance with the amount of time that the diver spends under water at the working depth, with these discrete supersaturation ratios allowing very satisfactory approximations to the actual diving parameters.

The method of calculating a diving plan in accordance with our invention may be summarized as follows. The dive parameters comprising the uptake and elimination time constants, the supersaturation ratio required given the amount of time that the diver will spend at the working depth, and the working depth itself, are first determined. It is then possible to calculate the inert gas pressure in the diver's body tissue at the end of the dive at the working depth using these dive parameters. The pressure in the diver's tissue will, of course, be proportional to depth of the dive. Thus, it is necessary to calculate the absolute inert gas pressure $P_{ei}$ in the diver's tissue at the end of a time period at the working depth pressure $P_w$ (corresponding to the working depth $d_w$). The foregoing literal numbers and others used herein are intended to represent general numerical values, as is customary. If the initial inert gas absolute pressure in the diver's tissue at the beginning of the dive is equal to a known pressure $P_i$, and $t_w$ is the time spent at the working depth, the pressure $P_{ei}$ in the diver's tissues may be calculated from the following equation:

$$P_{ei} = (P_i - P_w)\, e^{-t_w/T_u} + P_w$$

ps The time constant $T_u$ is the time constant of uptake of the inert gas and is preferably determined in a manner which allows the closest fit of the results derived from the equation above to actual empirical data such as that obtained from Navy diving tables. We have determined that a satisfactory result for an air breathing mixture and for the average diver is obtained using an uptake time constant $T_u$ equal to 47 minutes. However, adjustment of the uptake time constant value (as well as the elimination time constant) may be made in order to obtain more accurate results for particular individuals, and for the conditions of the dive such as metabolic rate and temperature.

After the inert gas tissue pressure $P_{ei}$ at the end of the dive at depth $d_w$ has been calculated, it may be decided if it is safe for the diver to surface immediately, or if a decompression schedule must be calculated. This may be accomplished by dividing the tissue pressure $P_{ei}$ of the diver by the ambient pressure $P_o$ at the surface, and comparing the quotient with the appropriate supersaturation ratio S. If the quotient is less than the supersaturation ratio, the diver may return immediately to the surface without the need for decompression.

For the case where decompression is required, the ambient absolute pressure at the required first decompression stop may be calculated by dividing the tissue pressure $P_{ei}$ by the appropriate supersaturation ratio S to determine the ambient pressure $P_{sl}$ at the first safe decompression stop. Thus, the pressure $P_{sl}$ at the first decompression stop can be determined from the following equation:

$$P_{s1} = \frac{P_{ei}}{S} = \frac{(P_i - P_w)\, e^{-\frac{t_w}{T_u}}}{S} + \frac{P_w}{S}$$

Since the depth of the stop will be proportional to the pressure $P_{sl}$ at the decompression stop, (i.e. $P_{sl} = 0.43\, d_{sl} + P_o$) the depth of the stop may be calculated from the following equation:

$$d_{s1} = \frac{d_w}{S} + \frac{(P_i - P_o - 0.43\, d_w)}{0.43\, S}\, e^{-\frac{t_w}{T_u}} - \frac{K}{S}(S - 1)$$

where $d_w$ is the working depth in feet, $d_{sl}$ is the depth of the first decompression stop, $K = P_o/0.43$ and $P_o$ is the absolute pressure at the surface (14.7 psia at sea level). The constant $K$ is the depth in feet equivalent to the absolute atmospheric pressure at the surface.

We have determined that the constant variation of the supersaturation ratio S with dive time and dive pressure may be approximated by discrete values of supersaturation ratio, with the value of supersaturation ratio selected depending on the time spent at the working depth of the dive. A supersaturation ratio of 2.0 is generally accepted as a safe and conservative estimate, and it is commonly utilized in calculating decompression schedules. A supersaturation ratio of 2.0 is appropriate and safe for a longer duration dive of 1 to 2 hours or more, generally without regard to the depth of the dive. However, we have also determined that decompression times may be minimized safely by utilizing a second supersaturation ratio of approximately 2.2 for dives of 30 minutes to an hour, and a third supersaturation ratio of 2.4 for dives of 30 minutes or less, also generally without regard to the depth of the dive.

Safe diving schedules in accordance with our invention may be planned by calculating the first and any subsequent decompression stops using the conservative supersaturation ratio of 2.0, while the less conservative supersaturation ratios may be used to determine the amount of time that the diver must spend at the decompression stop. Using a constant supersaturation ratio of 2.0, the equation for the decompression stop becomes:

$$d_{s1} = \frac{d_w}{2} + \frac{1}{0.86}(P_i - P_o - 0.43\, d_w)\, e^{-\frac{t_w}{T_u}} - \frac{K}{2}$$

where $P_o = 14.7$ psia and $K = 34.2$ feet for dives from seal level. Where $P_i$ is given in terms of an equivalent depth $d_i$, and assuming a dive from sea level, this equation becomes $$d_{s1} = \frac{d_w}{2} + \frac{1}{2}(d_i - d_w)\, e^{-\frac{t_w}{T_u}} - 17.09.$$

After the decompression stop is known, the time $t_l$ that the diver is required to remain at the decompression stop in order to lower his tissue pressure to a desired pressure $P_l$ may be calculated from the following equation:

$$t_1 = -T_e \ln\left[\frac{P_l - P_{s1}}{P_{ei} - P_{s1}}\right]$$

where "ln" is the logarithm to the base $e$. The time constant $T_e$ of elimination of inert gas from body tissues is not identical to the time constant $T_u$ of uptake of the inert gas, but is, in fact, substantially different. We have determined that an elimination time constant $T_e$ of approximately 70 minutes provides a satisfactory approximation to the empirical data for air breathing mixtures, although our decompression plan device is not limited to particular chosen time constants of uptake and elimination. The final pressure $P_l$ in the equation above is determined such that $P_l$ divided by the ambient pressure $P_o$ at the surface is equal to the appropriate supersaturation ratio S, depending on the amount of time spent at the working depth, as explained above.

If the surface can be reached with only one decompression stop, the time required at that stop may be obtained from the following equation:

$$t_1 = T_e \ln\left[\frac{P_o + 0.43 d_{s1}}{P_o(S - 1) - 0.43 d_{s1}}\right] = T_e \ln\left[\frac{K + d_{s1}}{K(S - 1) - d_{s1}}\right]$$

The pressure $P_o$ at the surface will be approximately 14.7 psia at sea level, wherein $K = 34.2$ feet, and as noted above, $S$ may be chosen equal to 2.0, 2.2, or 2.4, depending on the dive time.

If the pressure $P_l$ that must be reached in order to surface safely is less than the pressure $P_{sl}$ at the decompression stop calculated, it is necessary for the diver to proceed to at least one more decompression stop before surfacing. This next required decompression stop can be calculated if the time that the diver spends at the first decompression stop is known. For staged decompression, the amount of time that a diver spends at the first decompression stop is arbitrary, and may be chosen at the convenience of the diver. Alternatively, if the depth of the second decompression stop is chosen arbitrarily, the time required at the first stop may be calculated. If the amount of time that the diver spends at the first decompression stop is selected, the pressure $P_t$ of the inert gas in the diver's tissues at the end of the selected time period can be calculated, and this pressure can be divided by the supersaturation ratio to determine the pressure $P_{s2}$ at the next required decompression stop, and thus the depth of the next decompression stop. The final pressure at the first decompression stop can be utilized as the initial pressure for calculation of the next decompression stop, and the total time required to decompress at the next decompression stop can be calculated. Again, if it is not possible to reach a safe pressure at the second decompression stop, a third decompression stop must be calculated in the manner given above. It is apparent that any number of required additional decompression stops may be calculated in this manner.

Figure 2:
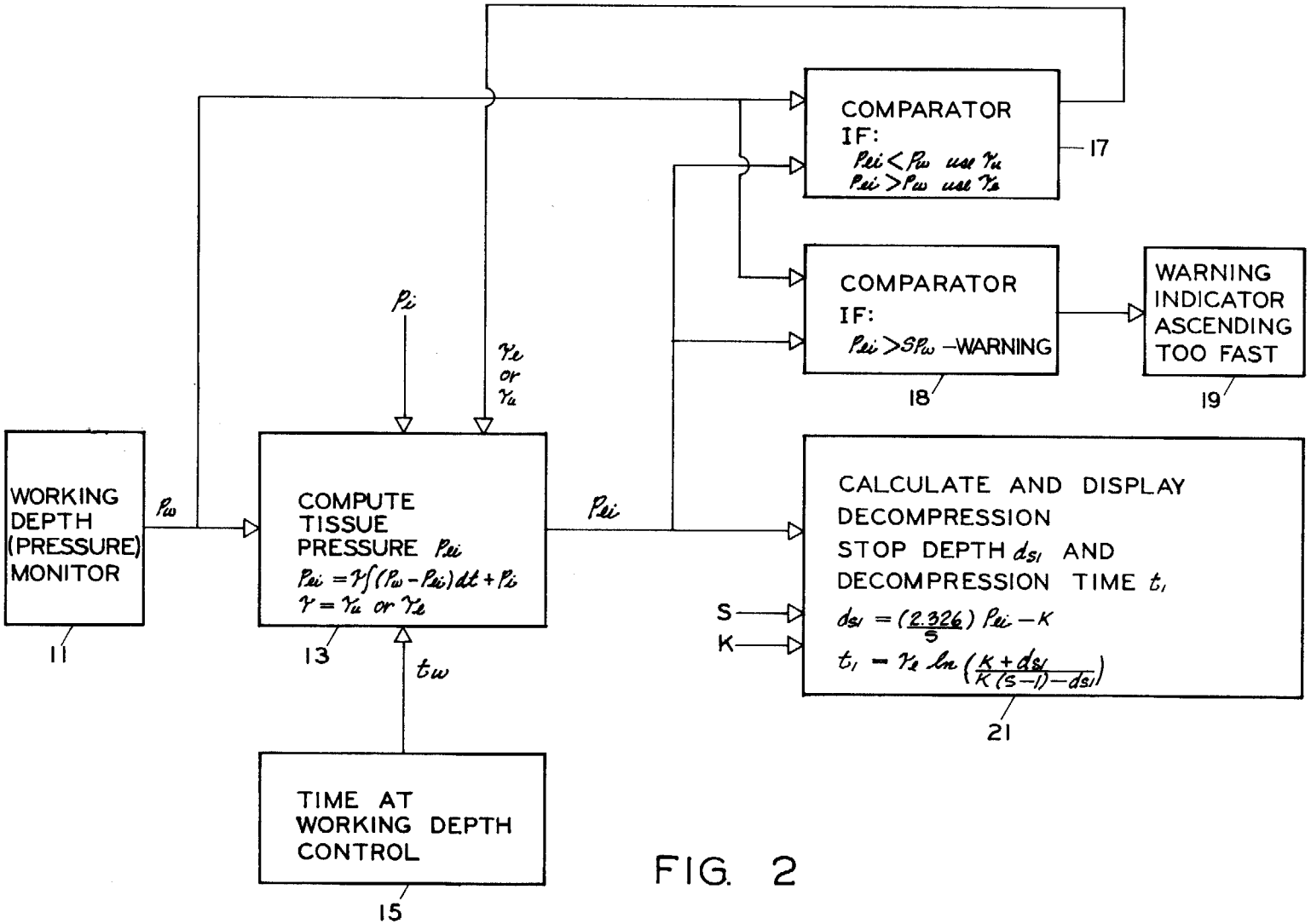
FIG. 2 is a schematic block diagram showing the fundamental functional elements of the decompression plan device of FIG. 1, and their relationship to one another.

Referring now more particularly to the drawings, wherein like numerals refer to like parts throughout the several views, a front view of a preferred embodiment of our decompression plan device is shown generally at 10 in FIG. 1, wherein the controls of the decompression plan device and the output displays are illustrated. A schematic flow diagram of the operation of our decompression plan device is shown in FIG. 2. With reference to FIG. 2, a signal corresponding to the pressure $P_w$ at the working depth $d_w$ of the diver is determined by a working depth monitor 11. For dives that are planned beforehand on the surface, a working depth control 12 on the face of the plan device is used to preset the expected working depth $d_w$ at the bottom of the dive where the diver will be spending the majority of his time under water. For dives being monitored in real time, that is, while the dive is actually taking place, the working depth monitor 11 utilizes a pressure transducer (not shown in FIG. 2) which the diver carries with him to generate a signal which is proportional to the instantaneous pressure at the depth at which the diver finds himself. Thus, continuous real time monitoring of the dive provides a somewhat more accurate decompression schedule than preplanned dives, since the preplanned dives assume that the transit time from the surface to the working depth is insignificant and may be ignored. This is generally a valid assumption for most dives in which work is to be performed at a depth which is known beforehand. It may be noted that the entire decompression plan device may be carried with the diver in a water and pressure proof partially transparent container (not shown), or the diver may carry only the pressure sensor connected by wire to an operator at the surface, wherein the operator indicates by wire to the diver when he may ascend and to what level.

An electrical signal corresponding to the pressure $P_w$ at the working depth, as continuous sensed or as preset, is provided from the working depth pressure monitor 11 to a tissue pressure computing circuit 13. The computing circuit 13 utilizes the pressure signal $P_w$ and a value for the initial tissue pressure $P_i$ in the diver's tissues which is set by the operator on an initial pressure control 14 on the face of the decompression plan device. The computing circuit 13 computes the instantaneous simulated tissue pressure $P_{ei}$ which is calculated on the assumption of a single simultated tissue having a time constant of uptake $T_u$ and a time constant of elimination $T_e$ which are substantially different. The resulting equation simulating the diffusion process in a single body tissue is given as follows:

$$P_{ei} = T \int (P_w - P_{si})\, dt + P_i$$

The constant T is selected to be either $T_u$ or $T_e$ depending, respectively, on whether the working depth pressure is greater than the simulated tissue pressure or whether the converse is true.

For dives that are preplanned at the surface, the amount of time $t_w$ that the diver will spend at the working depth is set on a time and working depth control 15 having a time at working depth dial 16 on the face of the decompression plan device. The computing circuit 13 will continue to compute the tissue pressure $P_{ei}$ until the time at the working depth has expired, at which time the computation is discontinued.

For computations in real time, where the diver is actually underwater, the computations continue until the diver reaches the surface. For this case, once the diver begins ascending from the working depth he will eventually ascend to a depth where the pressure in his tissues is greater than the ambient pressure. At this point, the inert gases in the driver's tissue begin to be eliminated therefrom, and the rate of elimination will be governed by the time constant $T_e$ of elimination. A comparator 17 controls the time constant which the tissue pressure computing circuit 13 utilizes when calculating the instantaneous tissue pressure. The comparator 17 is provided with the working depth pressure signal $P_w$ and the calculated simulated tissue pressure signal $P_{ei}$, and the comparator 17 compares the values of these pressures and commands the computing circuit 13 to use the uptake time constant $T_u$ where the tissue pressure is less than the working depth pressure, and to use the elimination time constant $T_e$ where the tissue pressure is greater than the working depth pressure.

Another comparator 18 is provided with the working depth pressure signal $P_w$ and the computed simulated tissue pressure signal $P_{ei}$ and compares the tissue pressure with the working depth pressure times a chosen supersaturation ratio S. As previously indicated, the supersaturation ratio varies with the depth of the dive and the dive time, but may be approximated by discrete values for the supersaturation ratio which depend on the length of time the diver is under water. It has been determined that a supersaturation ratio of approximately 2.0 provides a relatively safe approximation for most dives, and the comparator 15 may be present to use the supersaturation ratio 2.0, or other supersaturation ratios as appropriate where the length of dive is relatively short. If the instantaneous simulated tissue pressure signal exceeds the supersaturation ratio times the working depth pressure signal there is an immediate danger that the diver will begin to experience decompression sickness. Thus, the comparator 18 will send out a signal under this condition to a warning indicator 19 which may light up a light 20 as shown on the face of the decompression plan device.

The tissue pressure signal $P_{ei}$ calculated by the tissue pressure computing circuit 13 is provided to a display unit 21. The display unit utilizes the instantaneous tissue pressure and a supersaturation ratio S which is set on the display unit by the operator to calculate and display both the depth of the first decompression stop $d_{s1}$ and the decompression time $t_1$ required at that stop. This is easily accomplished for dives from sea level since the decompression depth $d_{s1}$ is a linear function of the instantaneous tissue pressure $P_{ei}$ and may be calculated from the equation given below:

$$d_{sl} = (2.326/s)\, P_{ei} - K$$

where K = 34.2 feet at sea level and $s$ is a chosen appropriate supersaturation ratio.

The decompression time may also be calculated and displayed as a function of the decompression stop depth $d_{sl}$ or the instantaneous tissue pressure signal $P_{ei}$. If the surface can be reached with only one decompression stop, the time $t_l$ required at the decompression stop may be calculated from the following equation:

$$t_1 = T_e \ln \left[ \frac{K + d_{s1}}{K(s-1) - d_{s1}} \right]$$

where $T_e$ is a chosen elimination time constant.

It can be seen that if the surface can be reached with only one decompression stop, the time for $t_l$ for decompression will be a single valued function of the decompression stop depth. The display unit 21 includes a meter display 22 on the face of the decompression plan device as shown in FIG. 1. The meter display 22 has a decompression stop scale 23, a first decompression time scale 24 and a second decompression time scale 25. The decompression stop scale 23 is measured off in feet below the surface, with the depth of the decompression stop being indicated by an indicator needle 26. The indicator needle 26 also points to a decompression time on either of the time scale 24 or the time scale 25. The markings of the time scale 24 and the time scale 25 with respect to the decompression stop scale 23 are determined in accordance with the equation given above for the decompression time $t_l$ as a function of the decompression stop depth $d_{sl}$ displayed on the face of the meter, wherein the supersaturation ratio S is chosen as 2.0 for the first decompression time scale 24 and as 2.2 for the second decompression time scale 25. The second time scale 25 is utilized for dives in which less than one hour is spent at the working depth, and the first time scale is used for dive times of greater than 1 hour.

It may be noted that if our decompression plan device is operating in real time, the diver may decompress continuously rather than at pre-set constant depth decompression stops. For example, the diver may ascend to the first decompression stop depth shown on the scale 23 of the display meter 22 and remain there safely. As the inert gas in his tissues is slowly eliminated, the needle 26 will slowly move upward to show decompression stops of progressively shallower depth. Thus, the diver may, at his discretion, progressively move up to the minimum decompression stop depth shown on the display meter 22 with the assurance that he will be free from decompression sickness at that depth. When the decompression stop reading on the scale 23 eventually rises above a depth of approximately 34.2 feet for seal level dives, or a depth equivalent to atmospheric pressure for dives in bodies of water above sea level, the decompression time indicated on the mater 22 may then be noted and the diver may remain at that depth for the time indicated on the meter, and then come directly to the surface.

Figure 4:
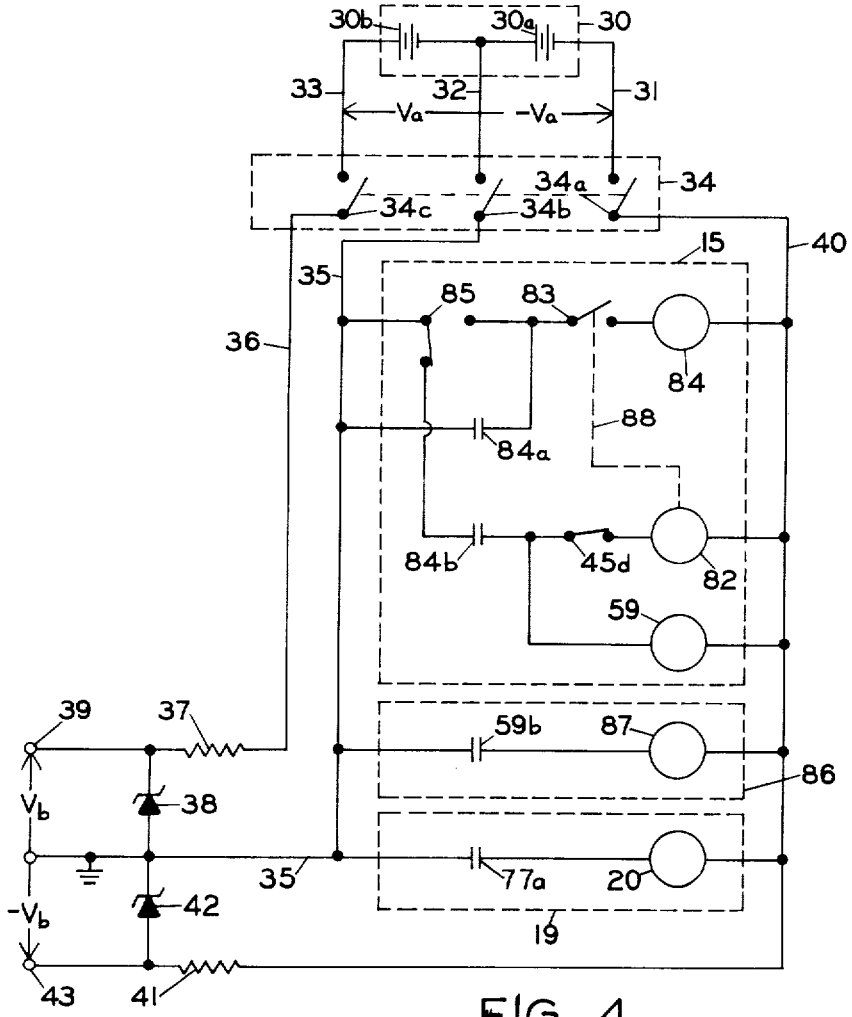
FIG. 4 is a schematic circuit diagram of another portion of the electrical circuitry of the decompression plan device of FIG. 1.

The power supply for our decompression plan device is shown in FIG. 4. The power supply includes a battery 30 which allows complete portability of our decompression plan device, although it is apparent that any other source of power such as rectified AC line power may be used to supply power to the electrical circuitry of our device. The battery 30 preferably consists of a first battery section **30*a* and a second battery section 30*b* which are connected in series. Each battery section is preferably of the same voltage level, equal to a chosen voltage $V_a$. The battery 30 has a first terminal 31 which is connected to the negative terminal of the first battery section 30*a*, a second terminal 32 which is connected to the connection between the positive terminal of the first battery section 30*a* and the negative terminal of the second battery section 30*b*, and a third terminal 33 which is connected to the positive terminal of the second battery section 30*b*.**

The three terminals of the battery are connected to an ON-OFF switch 34 which allows control of the supply of power to the decompression plan device from the front panel of the device, as shown in FIG. 1. The switch 34 has three switches ganged together with a first switch **34*a* connected to the battery terminal 31, a second switch 34*b* connected to the battery terminal 32, and a third switch 34*c* connected to the battery terminal 33. The other side of the second switch 34*b* is connected to a common line 35 which is preferably grounded. The other side of the switch 34*c* is connected to a conducting line 36 through a power resistor 37, across a Zener diode 38, and back to the common line 35. The Zener diode 38 is selected to have a chosen break-over voltage $V_b$ and is connected between a power supply terminal 39 and ground, wherein the voltage $V_b$ is of satisfactory magnitude to supply power to the electronic components of the decompression plan device. The side of the switch 34*a* opposite that connected to the battery is conneted to a conducting line 39, through a power resistor 40, and through a Zener diode 41 back to the common line 35. The Zener diode 41 also preferably has a break-over voltage of $V_b$ and has current flowing through it in the backwards direction from conductor 35 to conductor 39, thus resulting in a voltage of $-V_b$ from a power supply terminal 43 connected to the Zener diode 41 to the grounded common line 35.**

Figure 3:
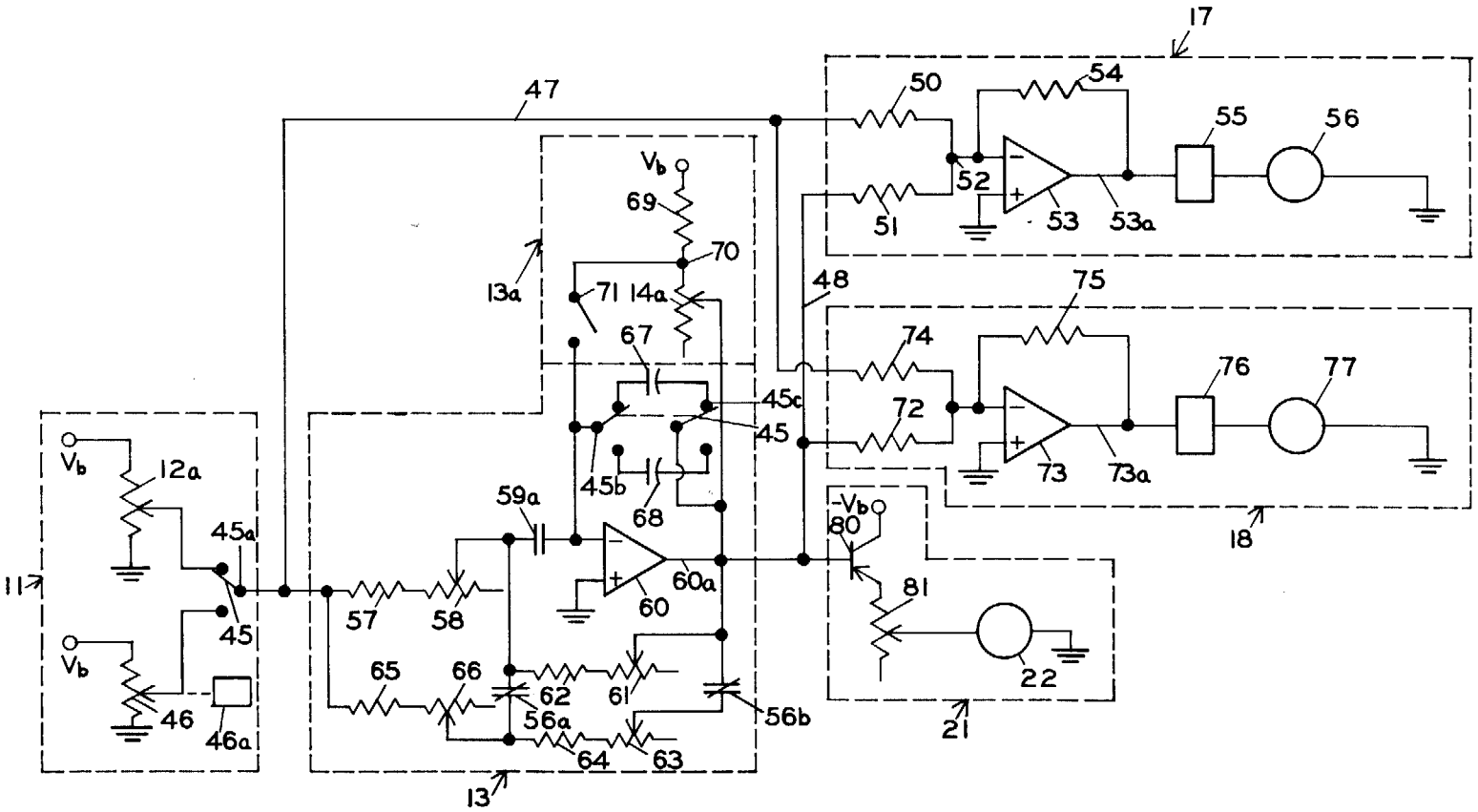
FIG. 3 is a schematic circuit diagram of a portion of the electrical circuitry of the decompression plan device of FIG. 1.

The electronic circuitry which accomplishes the functions of the diving plan device are shown in schematic form in FIG. 3 and FIG. 4. Referring to FIG. 3, the circuitry for generating a signal corresponding to the working depth pressure of the dive, or the working depth pressure monitor, is shown generally within the dashed line labeled 11. A working depth control potentiometer **12*a* is operated by the working depth control 12 on the face of the diving plan device, and is connected between the power supply voltage $V_b$ and ground. The wiper of the potentiometer 12*a* is connected to one terminal of a signal pole double throw switch 45. The other switched terminal of the switch 45 is connected to a potentiometer 46 connected between the power supply voltage $V_b$ and ground. The wiper of the potentiometer 46 is mechanically linked to and operated by a depth sensor 46*a* which is carried by the diver and which sensed the pressure at which the diver finds himself. Any depth gauging instrument which provides a mechanical deflection proportional to pressure may be utilized as the sensor 46*a*, although combined sensors which provide an electrical signal corresponding to ambient pressure may also be utilized. The position of the wiper along the potentiometer 46 is preferably proportional to the depth of the dive. The switch 45 allows selection by the operator of the diving plan device of scaled time operation by placing the switch 45 in its upper position as shown in FIG. 3, wherein the dive is planned at the surface and the expected working depth is read in by means of the working depth control 12.**

With the switch 45 in its lower position, the working depth (or working pressure) is continuously monitored and an electrical signal proportional to the working depth is developed at the wiper of the potentiometer 46 and is transmitted therefrom through the switch 45.

The other side of the switch 45 is electrically connected to the tissue pressure computing circuit 13 shown generally within the dashed lines labeled 13 in FIG. 3, and provides the electrical signal corresponding to working depth pressure from the working depth monitor 11 to the tissue pressure computing circuit 13. The electrical signal corresponding to working depth pressure is also transmitted by conducting line 47 to the comparator 17 and the comparator 18, shown respectively within the dashed lines labeled 17 and 18 in FIG. 3.

The electrical signal corresponding to the pressure $P_w$ at the working depth, or the instantaneous ambient pressure of the diver, is compared by the comparator 17 to the simulated tissue pressure signal provided by the tissue pressure computing circuit 13 to the comparator 17 by means of a conducting line 48. The comparator 17 transmits the working pressure signal $P_w$ through a resistor 50, and the instantaneous tissue pressure signal $P_{ei}$ through a resistor 51, to a common node 52 which is connected to the inverting input of a high gain operational amplifier 53. The output of the amplifier 53 is fed back through a resistor 54 to the common node 52 at the input to the amplifier. The signal present on the conducting line 48, which is provided at the output of the tissue pressure computing circuit 13, is the negative of the tissue pressure signal $P_{ei}$, so that the output of the operational amplifier 53 is a constant times $P_{ei} - P_w$. The output of the amplifier 15 is fed to a relay driver 55 which provides sufficient power amplification to operate a relay coil 56. As indicated above, the voltage at the output terminal 53*a* of the operational amplifier 53 will be a constant times $P_{ei}$- $P_w$. As long as the working depth pressure signal $P_w$ is greater than the tissue pressure signal $P_{ei}$, so that the voltage at the output terminal 53*a* is negative, the relay driver will not activate the relay coil 56. However, when the tissue pressure signal becomes greater than the working depth pressure signal, the coil 56 will be activated.

The relay coil 56 controls two sets of relay contacts 56*a*and 56*b* within the tissue pressure computing circuit 13. The relay contacts 56*a* and 56*b* are normally closed, and thus are conducting when the ambient working depth pressure signal $P_w$ is greater than the tissue pressure signal $P_{ei}$. However, when the tissue pressure signal exceeds the working depth pressure signal, these contacts will be open, and this function allows the change of the time constant between the time constants of uptake and the time constant of elimination, as will be explained more fully below.

The output signal corresponding to the working depth pressure $P_w$ is supplied from the working depth monitor 11 to the tissue pressure computing circuit 13, and is transmitted therein through a resistor 57, a variable resistor 58, a normally open relay contact 59*a* and thence to the inverting input terminal of a high gain operational amplifier 60. The relay contact 59*a* is closed at the beginning of computation by the action of the time control circuit 15, and is opened again after the computations are completed. The voltage at the output terminal 60*a* of the operational amplifier 60, which corresponds to the negative of the simulated tissue pressure signal $P_{ei}$, is fed back to the inverting input of the amplifier through a variable resistor 61 and a fixed resistor 62. When the normally closed relay contacts 56*a* and 56*b* are in fact closed, the output voltage of the operational amplifier is also fed back through a variable resistor 63 and a fixed resistor 64 in series therewith, with the resistor 63 and 64 being connected in parallel with the resistor 61 and 62. Also, when the relay contact 56*a* is closed, the working depth pressure signal $P_w$ is fed to the inverting input of the amplifier 60 through a series connected fixed resistor 65 and a variable resistor 66, with the resistor 65 and 66 being connected electrically in parallel with the series connected resistors 57 and 58.

The output voltage at the output terminal 60*a* of the operational amplifier 60 is also fed back to the input thereof through either one of a first feedback capacitor 67 or a second feedback capacitor 68. The choice of capacitor is determined by the position of the function switch 45 which selects the modes of the decompression plan device between real time computations and scale time computations. When the function switch 45 is in its upper position for the scaled time mode, switch portions 45*b* and 45*c* of the function switch connect the capacitor 67 into a feedback configuration around the operational amplifier 60. This also corresponds to the switch portion 45*a* being in its upper position to connect the potentiometer 12*a* to the output of the working pressure monitor 11, so that the pressure at the working depth can be set by the operator by adjusting the working depth control 12 on the face of the decompression plan device. When the function switch 45 is in the real time position, the capacitor 68 is connected in the feedback configuration around the operational amplifier 60, and the voltage output of the potentiometer 46, which is controlled by a pressure sensor 46*a*, is provided through the function switch portion 45*a* to the tissue pressure computing circuit 13.

The operational amplifier 60, with either the capacitor 67 or the capacitor 68 in a feedback configuration around the amplifier, acts as an integrator to effectively provide a voltage signal at the output thereof which is the time integral of the current signal that flows into the input terminal of the operational amplifier. The comparator 17 controls the relay contacts 56*a* and 56*b* to select between a first circuit for providing input signals to the amplifier 60 and a second circuit for providing such signals. When the relay contacts 56*a* and 56*b* closed to simulate uptake of inert gas by the diver, the first circuit is employed and consists of resistors 57 and 58 in parallel with resistors 65 and 66 providing a current signal proportional to an uptake time constant times the working depth pressure signal $P_w$ to the amplifier input, and resistors 61 and 62 in parallel with resistors 63 and 64 providing a current signal proportional to the same uptake time constant times the negative of the simulated tissue pressure signal (i.e. $-P_{ei}$) to the amplifier input. These input signals are summed and integrated to provide the simulated tissue pressure signal $P_{ei}$ during uptake of inert gas.

When the relay contacts 56*a* and 56*b* are opened by the comparator circuit 15 to simulate elimination of inert gas by the diver, the second circuit is employed and consists of resistors 57 and 58 in series providing a current signal to the amplifier 60 input which is proportional to an elimination time constant times the working depth pressure signal $P_w$, and resistors 61 and 62 in series providing a current signal to the amplifier input which is proportional to the same elimination time constant times the negative of the simulated tissue pressure signal (i.e. $-P_{ei}$). These imput signals are summed and integrated to provide the simulated tissue pressure signal $P_{ei}$ during elimination of inert gas.

The value in microfarads of the second feedback capacitor 68 is determined such that the time constant of growth or decay of the output signal $P_{ei}$ corresponds as closely as possible to the actual time of intake and elimination of inert gases by a diver. The value of the first feedback capacitor 67 is smaller than the value of the capacitor 68, thus allowing the tissue computation circuit 13 to compute diving schedules on an analog basis at a faster rate than real time. The time constants of the computing circuit 13 with the feedback capacitor 67 being utilized can be calculated, and compared with the actual time constants of uptake and elimination of inert gas from a diver, and thus the amount of actual time that the computing circuit 13 is allowed to compute by the time control circuit 15 may be determined to correspond to the scaled amount of time that the diver would be spending at a selected depth of the dive. Adjustment of the time constants of uptake and elimination is easily accomplished by adjustment of the variable resistors 58, 61, 63, and 66. Adjustment of the time constants may also be desirable to accommodate differences in time constants between individual divers.

Since there will often be some residual nitrogen or other inert gas remaining in the diver's tissues as he begins a new dive, or the initial gas pressure may be due to the diver being at one depth level and wishing to ascend or descend to another level, it is necessary to be able to provide an initial pressure value or signal $P_i$ to the tissue pressure computing circuit 13. The setting of the initial pressure is preferably accomplished by placing an initial charge on either the capacitor 67 or the capacitor 68 before the computation of tissue pressure begins, which effectively combines the constant voltage initial pressure signal $P_i$ with the output of the amplifier 60 to provide the simulated tissue pressure signal $P_{ei}$. The portion of the tissue pressure computing circuit utilized to perform this initial charging of the feedback capacitor is shown generally within the dashed lines labeled **13*a* in FIG. 3. The charging circuit 13*a* has a fixed resistor 69 connected to the supply voltage $V_b$, with the fixed resistor 69 being connected in series to a variable resistor 14*a*. The wiper of the variable resistor 14*a* is electrically connected to the switch 45*c*. The wiper of the variable resistor 14*a* is mechanically operated by the current decompression stop—initial pressure control 14, with the scale of the control 14 on the face of the plan device preferably being marked off in depth in feet below the surface, since initial pressure may be easily converted to initial depth. The node 70 at the connection between the resistor 69 and the variable resistor 14*a* is connected to a push button switch 71 which is operated from the face of the decompression plan device as shown in FIG. 1, and which allows the initial pressure setting circuit 13*a* to be selectively connected into the remainder of the working depth tissue pressure circuit when the switch 71 is in its closed position. The other side of the switch 71 is electrically connected to the switch 45*b***.

Depending on the position of the switch portions **45*b* and 45*c* of the switch 45, either the first feedback capacitor 67 or the second feedback capacitor 68 will be given the charge corresponding to the initial pressure signal which is provided by the initial pressure charging circuit 13*a*. During the charging operation, the relay contact 59*a* is open and the pressure setting switch 71 may then be closed. It is apparent that the voltage charge that will be placed upon the capacitors 67 or 68 will be equal to the supply voltage $V_b$ times the ratio of the variable resistance of the resistor 14*a* divided by the resistance of the resistor 69**. The initial charge voltage may thus be adjusted to correspond to any desired initial tissue pressure.

The output signal $P_{ei}$ from the tissue pressure computing circuit 13 is provided to the comparator 18 on the conducting line 48, and as previously indicated, the working depth pressure signal $P_w$ is provided on the conducting line 47 to the comparator 18. Within the comparator 18, the simulated tissue pressure signal $P_{ei}$ is conducted through a fixed resistor 72 to the inverting input of a high gain operational amplifier 73, and the pressure signal $P_w$ corresponding to the working depth pressure is conducted through a fixed resistor 74 to the inverting output of the amplifier 73. The output signal at the output terminal **73*a* of the operational amplifier is fed back through a resistor 75 to the inverting input of the amplifier. The output signal of the amplifier 73 at the output terminal 73*a* is also conducted to a relay driver 76 which provides power amplification and is connected to and drives a relay coil 77. The resistors 72, 74 and 75 are selected in value such that the output at the output terminal 73*a* of the amplifier 73 is equal to a constant times the quantity $P_{ei} - S\,P_w$, where S is a selected number representing the supersaturation ratio. Thus, the relay coil 77 will be activated whenever the tissue pressure $P_{ei}$ exceeds S times $P_w$. The purpose of the comparator 18 is to give the diver a warning if at any time during the dive he ascends to an unsafe working depth where he may be subject to decompression sickness. For maximum safety under a wide variety of working conditions, the supersaturation ratio S may be safely selected to be 2.0 although other values for S may be chosen where appropriate. With reference to FIG. 4, the relay coil 77 closes a normally open relay contact 77*a*, which is connected in series with the warning light 20 between the conducting line 40 and the common line 35 in the warning indicator circuit 19. When the relay contact 77*a* is closed, the voltage between the conducting lines 40 and 35 will be placed across the warning light 20**, which will light up and provide a danger signal on the face of the decompression plan device. If the decompression plan device is operated at the surface, the operator may communicate this warning to the diver in an appropriate manner.

The display circuit shown within the dashed lines labeled 21 in FIG. 1, provides an output display on the meter 22 which corresponds to the depth $d_{sl}$ of the decompression stop required given a simulated tissue pressure in the diver's tissues, and also the time that the diver must spend at the decompression stop. As shown in FIG. 3, the output signal $P_{ei}$ from the tissue pressure computing circuit 13 is preferably provided to the base input of a PNP transistor 80 having its collector connected to the supply voltage $-V_b$, and with its emitter connected to a variable resistor 81. The wiper of the variable resistor 81 is connected through the meter 22 to ground. The transistor 80 provides current gain for the simulated tissue pressure signal $P_{ei}$ to drive the meter movement of the meter display 22. It is apparent that other equivalent displays may be utilized in place of the meter display 22, as for example, a digital output display which relates the magnitude of the simulated tissue pressure signal $P_{ei}$ to a digitized output display of the decompression stop depth $d_{sl}$ and decompression time.

As described above, the relative position of the numerical values of the scales 23, 24, and 25 on the meter display 22 are selected to yield numerical meter readings which correspond to the values for decompression stop depth $d_{sl}$ and decompression stop time $t_1$ in accordance with the equations therefor given above. The variable resistor 81 allows adjustment of the meter to correspond to the desired supersaturation ratio S to be used for determining the decompression stop depth. An adjustment knob 81*a* is provided on the face of the decompression plan device as shown in FIG. 1 which is mechanically connected to the wiper of the variable resistor 81 to allow the adjustment of the resistance value thereof from the face of the decompression plan device. Adjustment of the value of the equivalent pressure constant K (equal to 32.4 feet at sea level) may be made by adjusting the null setting screw 22*a* on the face of the meter 22.

For scaled time operation, it is necessary to run the computing process for a predetermined amount of time and then terminate it at a scaled amount of time corresponding to the actual time which the diver is to spend at the working depth. This control of the scaled time is accomplished by the time at working depth control circuit shown generally within the dashed lines labeled 15 in FIG. 4. The time control circuit 15 has a servomotor 82 mechanically connected to the time at working depth control dial 16 on a face of the decompression plan device. The servomotor 82 runs at constant speed with constant voltage, and is selectively connected into the circuit by a switch 45*d* which is a portion of the function switch 45, wherein the switch 45*d* is in its closed position when the switch 45 is placed in its scaled time position. The servomotor 82 is electrically disconnected by the opening of a switch portion 45*d* when the function switch 45 is placed in its real time position.

To obtain initiation of computation, the operator first closes a switch 83 which is connected to a relay coil 84. A two position push button switch 85 is then depressed by the operator and momentarily placed in its upper position so that a complete conducting path is formed from the conducting line 40 through the relay coil 84, the switch 83, and the switch 85 to the common line 35 to activate the coil 84. Activation of the coil 84 closes a normally opened relay contact 84*a* which is connected in parallel with the switch 85 and which provides a parallel conducting path around the switch 85 to keep the relay 84 activated. The switch 85 is then released to its lower position, while the relay coil 84 remains activated through the conducting path formed by the relay contacts 84*a,* the switch 83, and the relay coil 84. The relay coil 84 also activates a set of normally closed relay contacts 84*b* which provide a conducting path from the common line 35 through the switch 85 when it is in its lower position, and thence through the switch 45*d* in the servomotor 82 to the conducting line 40, and in parallel with the servomotor and the switch 45*d,* through a relay coil 59. The relay coil 59, when energized, closes the normally opened contacts 59*a* in the computing circuit 13, and also closes normally open relay contacts 59*b* in a computing indicator circuit shown within the dashed lines labeled 86 in FIG. 4. Closing of the relay contacts 59*b* completes a conducting path from the common line 35 through the relay contacts 59*b* to a computing indicator light 87 and thence to the conducting line 40. The light 87 provides an indicator on the face of the decompression plan device to indicate to the operator that the device is in fact computing a diving schedule, either in real time or in scaled time.

As long as the relay coil 84 remains activated, power will be supplied to the servomotor 82 and the the relay coil 59 to maintain the computing circuit in its computing mode. The time which the diver will spend at the working depth when a scaled time decompression plan is being calculated, is set by turning the dial of the time at working depth control 16 to the number of minutes on the dial corresponding to the time that the diver will spend at the working depth. Once the push button switch 85 has been depressed to start computation, the servomotor 82 will be activated and will turn the dial of the control back toward 0 minutes, with the amount of time required for the dial to be set completely back to 0 being some predetermined portion of the actual real time that the diver will spend at the working depth. The servomotor 82 is mechanically connected by a linkage 88, shown schematically in FIG. 4, such that when the servomotor 82 has turned the dial 16 completely back to 0 minutes, the linkage 88 will open up the switch 83. Opening of the switch 83 will deactivate the relay coil 84, which will cause the contacts 84*a* and 84 b to open. Opening of these contacts turns off the servomotor 82 and also causes deactivation of the relay coil 59. The deactivation of the relay coil 59, in turn, causes the relay contacts 59*b* to open so that the computing light 87 is turned off, and also causes the relay contacts 59*a* to open to stop computation in the tissue pressure computation circuit 13. It may be noted with reference to FIG. 3, that opening of the relay contact points 59*a* will cause the voltage output signal of the operational amplifier 60, corresponding to the simulated tissue pressure, to stabilize at its then existing voltage, so that the reading obtained at that point in time will remain on the meter display 22 for convenient observation and recording by the operator of the dividing plan device.

When real time operation is selected, the switch 45*d* remains open so that the servomotor 82 is never activated. Thus, computation continues until the operator manually opens the switch 83 on the face of the diving plan device. During real time computation, the next safe decompression stop will be continuously displayed on the decompression stop scale 23 under the indicator needle 26, and the amount of time that the diver must spend at that stop will be displayed either on the decompression time scale 24 or the time scale 25, depending on the length of the dive and the corresponding supersaturation ratio required. The diver continues to ascend and will be assured that his diving rate is safe as long as he remains below the decompression stop depth shown on the decompression stop scale 23, until he reaches a depth which is less than a depth equivalent to twice the pressure at the surface. This depth is 34.2 feet at sea level. Upon reaching such a depth, the diver has the option of remaining at that depth for a length of time shown on the appropriate decompression time scale under the indicator needle 26, or continuing to ascend in accordance with the reading on the decompression stop scale. However, the minimum time required to surface will be obtained if the diver remains at the first safe depth for the required length of time and then comes directly to the surface.

Our decompression plan device 10 may also be utilized to preplan staged decompression dives, wherein the diver must remain at more than one prechosen decompression stop for varying lengths of time before he can ascend to the surface. An example of such a staged decompression dive may be illustrated with reference to the face of the decompression plan device shown in FIG. 1. Assuming that the diver has been at the surface (e.g. sea level) for a considerable period of time, preferably greater than 12 hours, his tissue pressure will be approximately the ambient surface pressure (e.g. sea level). Thus, the initial pressure control 14 is set to 0 and the push button switch 71 is depressed to cause this initial value to be placed on the capacitor 67. The switch 45 has previously been placed on the scaled time position, and the switch 83 is switched to the "compute" position. The time to be spent at the working depth, for example one hour, is then dialed on the working depth time control 16. The expected working depth, for example, 150 feet, is set on the working depth control 12. The push button switch 85 is then depressed to begin computation, and released. Computation continues until the working depth control 16 has reached 0 minutes, at which time the computing circuits are opened. The needle 26 remains at its then existing position, which allows the operator to read and record the required first decompression stop on the decompression stop scale 23. This value is then set on the working depth scale 12. The operator then calculates the instantaneous tissue pressure in the diver's tissues when he initially reaches the decompression stop depth shown on the scale 23. This is easily calculated since the equivalent depth $d_{ei}$ which would yield an ambient pressure equal to $P_{ei}$ at that depth under water, is related to the decompression stop depth $d_{sl}$ such that $d_{ei} = S\, d_{sl}$. This equivalent depth corresponding to the diver's initial tissue pressure is set on the initial pressure control 14 and the push button 71 is depressed to set this pressure. By resetting the initial pressure, the previous output of the initial pressure computing circuit 13 is eliminated and replaced by the voltage corresponding to the setting of the initial tissue pressure. The time that the diver chooses to spend at the first decompression stop is then dialed on the time at working depth control 16, the switch 83 is turned to its compute position, and the push button switch 85 is depressed to start computations. After the servomotor 82 has turned the time at working depth control 16 back to 0 minutes, the computation stops. The next required decompression stop is read on a decompression stop scale 23. If this decompression stop is at a depth less than a depth equivalent to twice the ambient pressure at the surface, the diver may remain at this depth for a period of time as read on the decompression time scale 24, and then come directly to the surface. This depth is approximately equal to 34.2 feet below the suface at sea level. However, if the next decompression stop is not above the critical depth, the diver must plan yet another decompression stop. This is easily accomplished in the manner determined before by computing the equivalent tissue pressure in the diver's tissues at that time in which he ascends to the second decompression stop, with this equivalent depth being set on the initial pressure control 14, with the next chosen decompression stop being set on the working depth control 12, with the desired time to be spent at the second decompression stop being dialed on the time of the working depth control 16, with the switch 83 turned to compute position, and with computation started by depressing the compute switch 85. This procedure may be repeated as often as necesssary for the diver to achieve a decompression stop depth less than the critical depth.

For illustrative purposes, to utilize a decompression plan having an uptake time constant $T_u$ equal to 47 minutes, and an elimination time constant $T_e$ equal to 70 minutes, and a supersaturation ratio S equal to 2.0, utilized for calculating decompression stop depths, numerical values are given below for the components of the circuit shown in the drawings which will provide a decompression plan in accordance with these physical parameters.

| COMPONENT | VALUE |
|---|---|
| Potentiometer 12a | 1 M ohms |
| Variable resistor 14a | 10 K ohms |
| Battery 30 | 22.5 V per section |
| Power resistor 37 | 20 ohms |
| Zener diode 38 | 15 V breakover |
| Power resistor 41 | 20 ohms |
| Zener diode | 15 V breakover |
| Potentiometer 46 | 1 M ohms |
| Resistor 50 | 100 K ohms |
| Resistor 51 | 100 K ohms |
| Resistor 54 | 10 M ohms |
| Resistor 57 | 1 M ohms |
| Variable resistor 58 | 1 M ohms |
| Variable resistor 61 | 1 M ohms |
| Resistor 62 | 1 M ohms |
| Variable resistor 63 | 1 M ohms |
| Resistor 64 | 1 M ohms |
| Resistor 65 | 1 M ohms |
| Variable resistor 66 | 1 M ohms |
| Capacitor 67 | 5.0 microfarads |
| Capacitor 68 | 7.69 microfarads |
| Resistor 69 | 10 K ohms |
| Resistor 72 | 200 K ohms |
| Resistor 74 | 100 K ohms |
| Resistor 75 | 10 K ohms |
| Transistor 80 | 2 N 65 |
| Resistor 81 | 20 K ohms |

The variable resistors may be adjusted to allow the desired time constants to be precisely obtained.

it is understood that our invention is not confined to the particular embodiments herein illustrated and described, but embraces all such modified forms thereof as come within the scope of the following claims.

We claim:

1. A decompression plan device for an underwater diver comprising:

a. pressure monitor means for sensing the ambient working depth pressure of a diver and for providing an electrical signal corresponding thereto;

b. computing means for receiving the working depth pressure signal and for computing an electrical output signal corresponding to the simulated tissue pressure due to the uptake and elimination of inert gases at the working depth pressure in a single simulated tissue having an uptake time constant and a different elimination time constant; and c. display means for receiving the tissue pressure signal and for displaying a safe decompression stop depth corresponding to the tissue pressure signal and to a chosen supersaturation ratio.

2. A decompression plan device for an underwater diver comprising:

a. pressure monitor means for producing an electrical signal proportional to the expected working depth pressure of a dive;

b. computing means for receiving the working depth pressure signal and for computing an electrical output signal corresponding to the simulated tissue pressure due to the uptake and elimination of inert gases in a single simulated tissue having an uptake time constant and a different elimination time constant;

c. time at working depth control means for controlling said computing means to compute the simulated tissue pressure signal for a period of time corresponding to a chosen expected time at the working depth; and d. display means for receiving the tissue pressure signal and for displaying a safe decompression stop depth corresponding to the tissue pressure signal and to a chosen supersaturation ratio.

3. The decompression plan device specified in claim 2 including means for providing a signal corresponding to the initial tissue pressure of a diver and for combining the initial pressure signal with the output signal of said computing means, with the combined signal corresponding to the simulated tissue pressure.

4. The decompression plan device specified in claim 2 wherein said display means also displays the amount of time required at the decompression stop depth before the diver may safely ascend to the surface if the surface can be reached without additional decompression stops.

5. The decompression plan device specified in claim 2 including means for comparing the tissue pressure signal and the working depth pressure signal and for indicating a warning if the tissue pressure signal is greater than a chosen supersaturation ratio times the working depth pressure signal.

6. The decompression plan device specified in claim 2 wherein said computing means computes the simulated tissue pressure signal in scaled time at a rate faster than the actual dive time rate and wherein said time at working depth control means controls said computing means to compute the simulated tissue pressure for a period of time corresponding to a scaled expected time at the working depth.

7. The decompression time calculator specified in claim 2 wherein said computing means receives a signal $P_w$ corresponding to the working depth pressure and a signal $P_i$ corresponding to the initial tissue pressure, and computes a signal $P_{ei}$ corresponding to the tissue pressure according to the equation $$P_{ei} 32\ T_u \int (P_w - P_{ei})\, dt + P_i$$

when the working depth pressure $P_w$ is greater than the tissue pressure $P_i$, and according to the equation $$P_{ei} = T_e \int (P_w - P_{ei})\, dt + P_i$$

when the working depth pressure $P_w$ is less than the tissue pressure $P_{ei}$, and wherein $T_u$ is a chosen time constant of uptake and $T_e$ is a chosen time constant of elimination of inert gases and $T_u$ and $T_e$ are not equal.

8. A decompression plan device for an underwater diver comprising:

a. pressure monitor means for sensing the ambient working depth pressure of a diver and for providing an electrical signal corresponding thereto;

b. integrator means having input and output terminals for providing a simulated tissue pressure output signal at the output terminal thereof that is the time integral of the signal provided to the input terminal thereof;

c. circuit means for receiving the working depth pressure signal and the simulated tissue pressure signal from the output of said integrator means, and including 1. first circuit means for providing a signal to said integrator means input terminal equal to a chosen uptake time constant times the difference of the working depth pressure signal minus the simulated tissue pressure signal when the working depth pressure signal is greater than the tissue pressure signal; and 2. second circuit means for providing a signal to said integrator means input terminal equal to a chosen elimination time constant times the difference of the working depth pressure signal minus the simulated tissue pressure signal when the working depth pressure signal is less than the tissue pressure signal; and d. display means for receiving the tissue pressure signal and for displaying a safe decompression stop depth corresponding to the tissue pressure signal and to a chosen supersaturation ratio.

9. The decompression plan device specified in claim 8 including means for providing an initial tissue pressure signal and for combining such signal with the output signal from said integrator means to provide a simulated tissue pressure signal.

10. The decompression plan device specified in claim 8 wherein said display means also displays the amount of time required at the decompression stop depth displayed before a diver may safely ascend to the surface if the surface can be reached without additional decompression stops.

11. The decompression plan device specified in claim 8 including means for comparing the tissue pressure signal and the working depth pressure signal and for indicating a warning if the tissue pressure signal is greater than a chosen supersaturation ratio times the working depth pressure signal.

12. The decompression plan device specified in claim 8 wherein said pressure monitor means includes means for producing an electrical signal proportional to the expected working depth pressure of a dive and for providing such signal to said circuit means, and also including time at working depth control means for controlling said integrator means to compute the simulated tissue pressure signal for a period of time corresponding to a chosen expected time at the working depth.

13. The decompression plan device specified in claim 12 wherein said integrator means integrates the input signal provided thereto in scaled time at a rate faster than the actual dive time and wherein said time at working depth control means controls said integrator means to integrate the input signal thereto for a period of time corresponding to a scaled expected time at the working depth.

14. The decompression plan device specified in claim 8 wherein said display means includes a meter having an indicator the deflection of which is proportional to the electrical signal provided to said meter, with said meter having a decompression stop scale thereon and wherein the markings on said decompression stop scale cooperate with said indicator such that for a simulated tissue pressure signal $P_{ei}$ provided to said meter, the decompression stop depth reading indicated by said indicator will be determined as being equal to 2.326 divided by S times $P_{ei}$ minus $K$, wherein $S$ is a chosen supersaturation ratio numerical value and $K$ is a constant numerical value equal to the depth of water below the surface which is equivalent in pressure to the atmospheric pressure at the surface.

15. The decompression plan device specified in claim 14 wherein said meter also includes a time scale and wherein the time scale readings are indicated by said indicator and are related to the decompression stop depth reading $d_{sl}$ such that the time scale readings will give the required time at the decompression stop depth equal to $$T_e \ln \left[ \frac{K + d_{sl}}{K(s-1) - d_{sl}} \right]$$

where $T_e$ is a chosen elimination time constant.

16. A decompression plan device for an underwater diver comprising:

a. pressure monitor means for producing an electrical signal proportional to the expected working depth pressure of a dive;

b. integrator means having input and output terminals for providing a simulated tissue pressure output signal at the output terminal thereof that is the time integral of the signal provided to the input terminal thereof;

c. circuit means for receiving the working depth pressure signal and the simulated tissue pressure signal, and including, 1. first circuit means for providing a signal to said integrator means input terminal equal to a chosen uptake time constant times the difference of the working depth pressure signal minus the simulated tissue pressure signal when the working depth pressure signal is greater than the tissue pressure signal, and 2. second circuit means for providing a signal to said integrator means input terminal equal to a chosen elimination time constant times the difference of the working depth pressure signal minus the simulated tissue pressure signal when the working depth pressure signal is less than the tissue pressure signal;

d. time at working depth control means for controlling said integrator means to compute the simulated tissue pressure signal for a period of time corresponding to the expected time at the working depth; and e. display means for receiving said tissue pressure signal and displaying a safe decompression stop depth corresponding to the simulated tissue pressure signal and to a chosen supersaturation ratio.

17. The decompression plan device specified in claim 16 including means for providing an initial tissue pressure signal and for combining such signal with the output signal from said integrator means to provide a simulated tissue pressure signal.

18. The decompression plan device specified in claim 16 wherein said display means also displays the amount of time required at the decompression stop depth displayed before the diver may safely ascend to the surface if the surface can be reached without additional decompression stops.

19. The decompression plan device specified in claim 16 wherein said integrator means integrates the input signal provided thereto in scaled time at a rate faster than the actual dive time and wherein said time at working depth control means controls said integrator means to integrate the input signal thereto for a period of time corresponding to a scaled expected time at the working depth.

20. A decompression plan device for an underwater diver comprising:

a. pressure monitor means for sensing the ambient working depth pressure of a diver and for providing an electrical signal corresponding thereto;

b. computing means for receiving the working depth pressure signal and computing an electrical output signal corresponding to a simulated tissue pressure due to the uptake and elimination of inert gases at the working depth pressure in a single simulated tissue having an uptake time constant and a different elimination time constant;

c. means for providing a signal corresponding to the initial tissue pressure of a diver and for combining the initial tissue pressure signal with the output signal of said computing means, with the combined signal corresponding to the diver's simulated tissue pressure; and d. display means for receiving the diver's simulated tissue pressure signal and for displaying a safe decompression stop corresponding to the tissue pressure signal and to a chosen supersaturation ratio.

21. A decompression plane device for an underwater diver comprising:

a. pressure monitor means for sensing the ambient working depth pressure of a diver and for providing an electrical signal corresponding thereto;

b. computing means for receiving the working depth pressure signal and for computing an electrical output signal corresponding to the simulated tissue pressure due to the uptake and elimination of inert gases at the working depth pressure in a single simulated tissue having an uptake time constant and a different elimination time constant; and c. display means for receiving the tissue pressure signal and for displaying a safe decompression stop depth corresponding to the tissue pressure signal and to a chosen supersaturation ratio and also displaying the amount of time required at the decompression stop depth before the diver may safely ascend to the surface if the surface can be reached without additional decompression stops.

22. A decompression plane device for an underwater diver comprising:

a. pressure monitor means for sensing the ambient working depth pressure of a diver and for providing an electrical signal corresponding thereto;

b. computing means for receiving the working depth pressure signal and for computing an electrical output signal corresponding to the simulated tissue pressure due to the uptake and elimination of inert gases at the working depth pressure in a single simulated tissue having an uptake time constant and a different elimination time constant;

c. display means for receiving the tissue pressure signal and for displaying a safe decompression stop depth corresponding to the tissue pressure signal and to a chosen supersaturation ratio; and d. means for comparing the tissue pressure signal and the working depth pressure signal and for indicating a warning if the tissue pressure signal is greater than a chosen supersaturation ratio times the working depth pressure signal.

23. A decompression plane device for an underwater diver comprising:

a. computing means for receiving a working depth pressure signal and for computing an electrical output signal corresponding to the simulated tissue pressure due to the uptake and elimination of inert gases at the working depth pressure in a single simulated tissue having an uptake time constant and a different elimination time constant;

b. pressure monitor means for sensing the ambient working depth pressure of a diver and for producing an electrical signal proportional to the expected working depth pressure of a dive and for providing such signal to said computing means, and also including time at working depth control means for controlling said computing means to compute the simulated tissue pressure signal for a period of time corresponding to a chosen expected time at the working depth; and c. display means for receiving the tissue pressure signal and for displaying a safe decompression stop depth corresponding to the tissue pressure signal and to a chosen supersaturation ratio.

24. The decompression plan device specified in claim 23 wherein said computing means computes the simulated tissue pressure signal in scaled time at a rate faster than the actual dive time and wherein said time at working depth control means controls said computing means to compute the simulated tissue pressure signal for a period of time corresponding to a scaled expected time at the working depth.

25. A decompression plane device for an underwater diver comprising:

a. pressure monitor means for sensing the ambient working depth pressure of a diver and for providing an electrical signal $P_w$ corresponding thereto;

b. computing means for receiving the working depth pressure signal $P_w$ and a signal $p_i$ corresponding to the initial tissue pressure, and for computing a signal $P_{ei}$ corresponding to the tissue pressure according to the equation $$P_{ei} = T_u \int (P_w - P_{ei})\, dt + P_i$$

when the working depth pressure $P_w$ is greater than the tissue pressure $P_{ei}$, and according to the equation $$P_{ei} = T_e \int (P_w - P_{ei})\, dt + P_i$$

when the working depth pressure is less than the tissue pressure $P_{ei}$, wherein $T_u$ is a chosen time constant of uptake and $T_e$ is a chosen time constant of elimination of inert gas and $T_u$ and $T_e$ are not equal; and c. display means for receiving the tissue pressure signal and for displaying a safe decompression stop depth corresponding to the tissue pressure signal and to a chosen supersaturation ratio.

26. A decompression plan device for an underwater diver comprising:

a. pressure monitor means for sensing the ambient working depth pressure of a diver and for providing an electrical signal corresponding thereto;

b. computing means for receiving the working depth pressure signal and computing an electrical output signal corresponding to the simulated tissue pressure due to the uptake and elimination of inert gases at the working depth pressure in a single simulated tissue having an uptake time constant and a different elimination time constant;

c. means for providing a signal corresponding to the initial tissue pressure of a diver and for combining the initial tissue pressure signal with the output signal of said computing means, with the combined signal corresponding to the diver's simulated tissue pressure; and d. means for comparing the tissue pressure signal and the working depth pressure signal and for indicating a warning if the tissue pressure signal is greater than a chosen super-saturation ratio times the working depth pressure signal.

27. A decompression plan device for an underwater diver comprising:

a. pressure monitor means for sensing the ambient working depth pressure of a diver and for providing an electrical signal corresponding thereto;

b. integrator means having input and output terminals for providing a simulated tissue pressure output signal at the output terminal thereof that is the time integral of the signal provided to the input terminal thereof;

c. circuit means for receiving the working depth pressure signal and the simulated tissue pressure signal from the output of said integrator means, and including 1. first circuit means for providing a signal to said integrator means input terminal equal to a chosen uptake time constant times the difference of the working depth pressure signal minus the simulated tissue pressure signal when the working depth pressure signal is greater than the tissue pressure signal; and 2. second circuit means for providing a signal to said integrator means input terminal equal to a chosen elimination time constant times the difference of the working depth pressure signal minus the simulated tissue pressure signal when the working depth pressure signal is less than the tissue pressure signal; and d. means for comparing the tissue pressure signal and the working depth pressure signal and for indicating a warning if the tissue pressure signal is greater than a chosen super-saturation ratio times the working depth pressure signal.

* * * * *